US005121989A

United States Patent [19]

Horton et al.

[11] Patent Number: 5,121,989

[45] Date of Patent: Jun. 16, 1992

[54] TRANSPORTABLE CONCRETE BATCHING APPARATUS

[75] Inventors: James Horton, Rochester; Ronald E. Christenson, Kasson, both of Minn.; Tim Irwin, Greensburg, Ind.

[73] Assignee: McNeilus Truck and Manufacturing, Inc., Dodge Center, Minn.

[21] Appl. No.: 491,498

[22] Filed: Mar. 12, 1990

[51] Int. Cl.[5] ..... B28C 7/06

[52] U.S. Cl. ..... 366/18; 366/26; 366/30

[58] Field of Search ..... 366/8, 18, 26, 30, 33, 366/141; 222/77, 129, 132, 459, 506; 414/21, 507, 523, 528

[56] References Cited

U.S. PATENT DOCUMENTS

| | | | |
|---|---|---|---|
| 2,109,534 | 3/1938 | Johnson | 366/18 |
| 2,493,898 | 1/1950 | Pollitz | 366/18 |
| 3,162,316 | 12/1964 | Camp | 366/606 X |
| 3,343,688 | 9/1967 | Ross | 366/18 X |
| 3,476,270 | 11/1969 | Cox et al. | 414/21 |
| 3,905,586 | 9/1975 | Wall, Jr. | 366/18 |
| 4,337,878 | 7/1982 | Brock | 222/77 X |
| 4,339,204 | 7/1982 | Placzek | 366/18 |
| 4,381,703 | 5/1983 | Crimmins et al. | 366/141 X |
| 4,775,275 | 10/1988 | Perry | 414/21 |
| 4,792,234 | 12/1988 | Doherty | 366/27 X |
| 4,815,042 | 3/1989 | Pratt | 366/141 |
| 4,836,421 | 6/1989 | Miyoshi et al. | 222/166 |
| 4,865,457 | 9/1989 | Strehlow | 366/18 |

*Primary Examiner*—Harvey C. Hornsby
*Assistant Examiner*—Scott J. Haugland
*Attorney, Agent, or Firm*—Haugen and Nikolai

[57] ABSTRACT

A transportable concrete batching plant is disclosed which combines improvements in the discharge section of the aggregate storage bin and aggregate batching hopper together with an unique suspension system which allows for weighing of both aggregate batching hopper and the cement batching vessel by a plurality of load cells and which also allows tension to be removed from the load cells if desired.

6 Claims, 4 Drawing Sheets

12
13
15
15A
61
62
19A
14
19
20
24
21
25
22
16
10
30
31
33
33A
32
17
34
5
5
18
11
23
26

TRANSPORTABLE CONCRETE BATCHING APPARATUS

BACKGROUND OF THE INVENTION

I. Field of the Invention

The present invention is generally directed to concrete batching systems and, more particularly, to improvements in a transportable batching plant.

II. Discussion of the Related Art

Permanent plants for preparing batches of concrete including mixing stone, sand, portland cement and water have long been used for premixing these materials prior to transferring them to transit carriers, including concrete mixer trucks, for delivery to job sites for pouring. Premixed concrete, however, is extremely heavy and must be used within a very limital time span after it is mixed. The need to haul concrete over long distances from permanent mixing plant installations to job sites, as is the case with highway construction or in the building of rather large facilities at sites remote from the nearest permanent concrete mixing establishment, have led to the development of transportable concrete batching systems which are capable of being moved via the highway system.

These are knock-down or readily disassembled units which fold and unfold on themselves to a certain degree for transport and installation at the desired batching site. While these transportable systems have greatly shortened the distances required to transport mixed or mixing concrete, the capacity of these portable units has been severely restricted because of legal highway transport size considerations. The height, length and width dimensions of the system as configured for highway travel have always been under critical limitations or constraints which, in turn, have limited the size of the containers and the clearance for other mechanisms of the system. In this regard, there has been a need for improving the relative size of the containers such as those for supplying stone and sand which can be utilized with such a system and also with increasing the transportable safety of delicate mechanisms such as strain gauges used to weigh the ingredients making up the dry batch.

SUMMARY OF THE INVENTION

By means of the present invention, certain significant improvements have been made in the capacity and transportability of portable concrete batching systems of the class described. These include a reduction of the clearance required to discharge the aggregate bins in relation to the aggregate batching hopper together with an improved, more accurate discharging mechanism for the aggregate hopper. The lower clearance allows the aggregate storage bins to gain a relative height advantage which, in turn, is reflected by a larger capacity for a given overall height. Improvements in the flow diverters in the bottom of the aggregate batcher, fed from the storage bins, provide better control of the flow of aggregate onto the aggregate conveyor and eliminate an additional prior problem. The invention further provides a novel approach to anchoring the very sensitive load cells to prevent damage during over-the-road transportation of the system which removes all the tension from the load cells.

The preferred embodiment of the transportable concrete mixing apparatus of the invention is a knock-down or readily assembled and disassembled form of system which folds and unfolds on itself, as the case may be, for installation on footings or to be packed for further highway travel. The system is designed to measure and load the dry ingredients of a concrete batch into a ready mix truck or other mixing container to which the water is added for mixing. The system includes aggregate storage bins, a cement silo, aggregate batcher for combining sand and stone from the storage bins in a manner which allows them to be individually weighed, a conveyor for conveying the batched aggregate to be loaded through a chute into a waiting mixing means and a cement batcher for weighing quantities of cement from the silo to be added to the batch.

In the preferred embodiment, the aggregate storage container includes several aggregate storage bins for containing stone and sand for use in concrete batching. Instead of the normal one or two bottom discharge cones, each of the bins is provided with four cone-shaped bottom discharge ports having synchronously-operated, clamshell-type doors. The increased number of cones decreases the height of individual cones allowing more room for batching material into the aggregate weigh hopper and thereby makes efficient use of the limited available vertical space above the discharge mechanism and more closely controls the discharge flow from the bins.

The aggregate batching apparatus consists of a weigh hopper positioned beneath the aggregate storage bins which is suspended using a plurality of sensitive load cells for accurately determining the weight of the hopper contents including proportioned amounts of stone and sand discharged into the hopper from the aggregate storage bins above. The aggregate batching apparatus also includes an improved bottom discharging system which is provided with a plurality of trapezoidal-shaped flow diverters in combination with dual clamshell gates to closely modulate the width of the discharge flow from the concrete aggregate batcher to a conveyor located just beneath the outlet gate for transporting the aggregate batch to be loaded for mixing. The use of the dual clamshell gate in conjunction with the four trapezoidal flow diverters increases the consistency of flow from the batching hopper to the conveyor.

The cement supply or batching system supplies the desired amount of portland cement to be included with the aggregate mix in a concrete batch in any proportion according to the desired recipe. The system includes a silo for storing quantities of cement and a cement weigh batcher disposed beneath the silo for receiving measured quantities of cement from the silo for addition to the batch.

The cement batcher is also, like the aggregate weigh hopper, suspended from a plurality of very sensitive load cells which accurately monitor the weight of the batching vessels and, thus, by differential weigh the amount of sand and stone received from the bins or cement received from the silo as the case may be. The cement is then discharged through a chute into the mixing device. Since the mixing device is normally a ready-mix truck, or the like, the entire system including the discharge chute fed by both the aggregate batching conveyor and the cement batching container must clear the top of the truck drum.

The mechanism for suspending both the cement weigh batching vessel and the aggregate batching weigh hopper vessel, in accordance with the invention, is a dual mode system in which the vessels are supported from the load cells when the batching system is operating but can be supported in a manner which allows all stress to be relieved from the load cells when desired, as when the system is in the shipping configuration. This involves a simple dual flange and pin system which anchors or supports the cement batching vessel or aggregate weigh hopper in place using a first set of flanges for transport which, at the same time, completely relieves all stress with regard to the load cells; and supports them from a second set of flanges when installed which causes the weight of the containers to be carried by the load cells during operation of the batching systems.

BRIEF DESCRIPTION OF THE DRAWINGS

In the drawings, wherein like numerals are utilized to designate like parts throughout the same.

DETAILED DESCRIPTION OF THE PREFERRED EMBODIMENT

In accordance with the present invention certain improvements in the geometric efficiencies of transportable concrete batching systems are achieved together with novel improvements regarding the suspension of the load cells so that when desired tension can be removed from the load cells. These improvements will now be described with particular reference to the several figures of the drawings which are meant to be illustrative only and not limiting in any manner.

Figure 1:
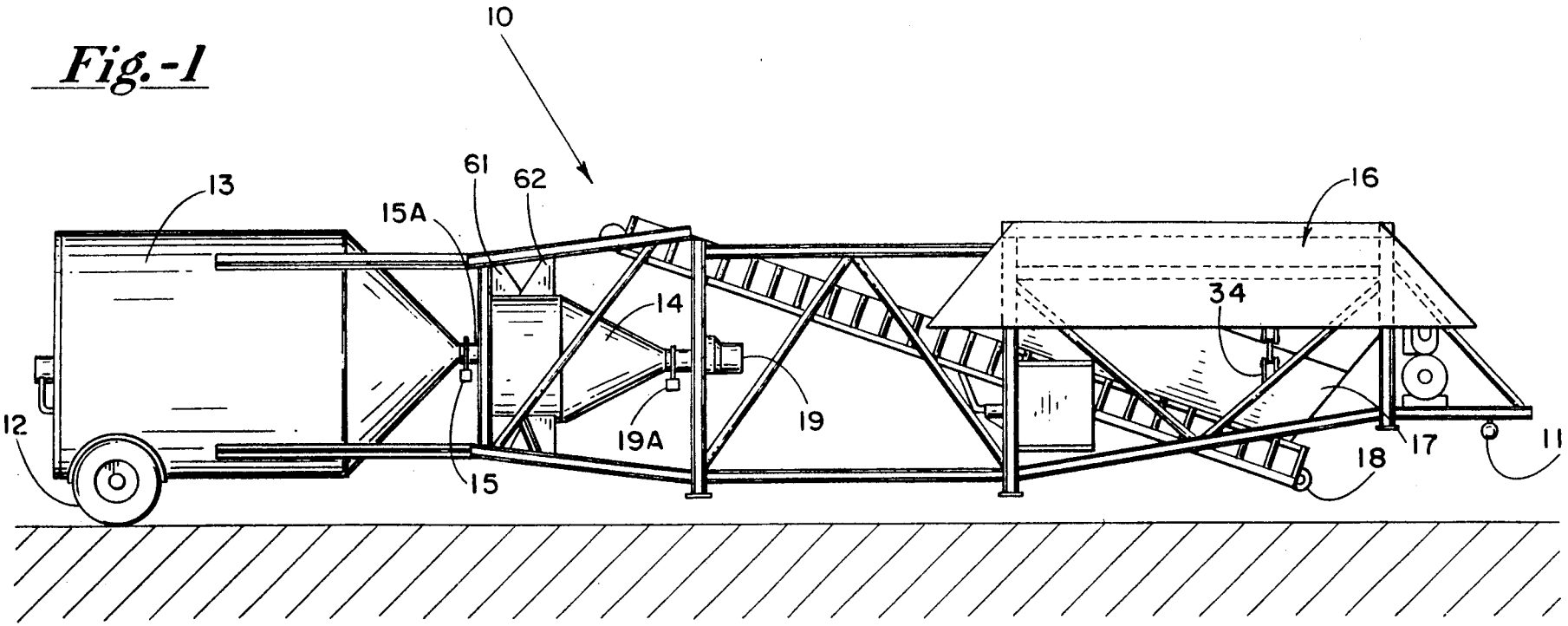
FIG. 1 is a side elevational representation of a transportable concrete batching apparatus including a cement silo in disassembled form ready for highway travel.
Figure 2:
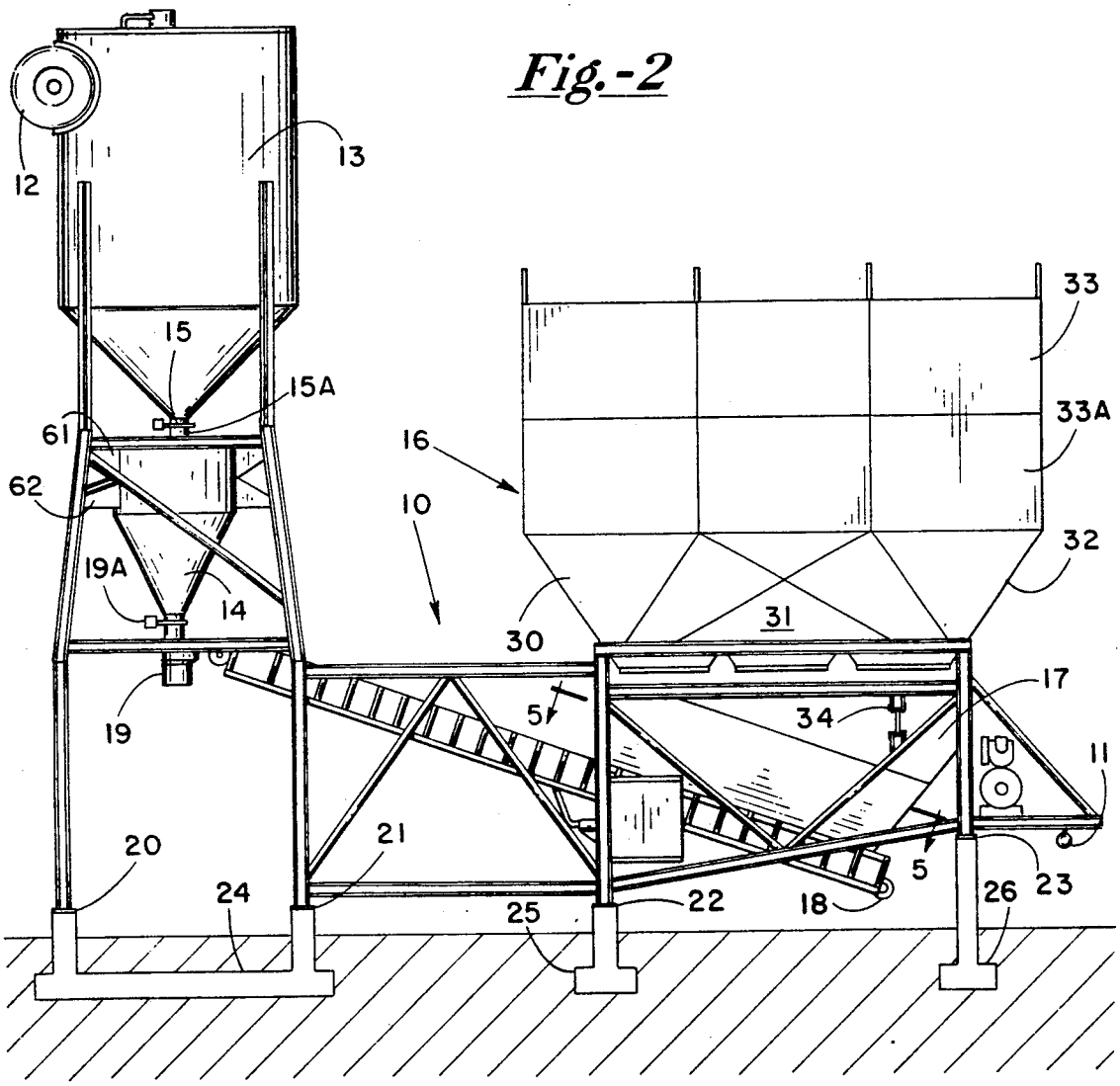
FIG. 2 is a side elevational view of the transportable concrete batching apparatus of FIG. 1 installed for operation.
Figure 3:
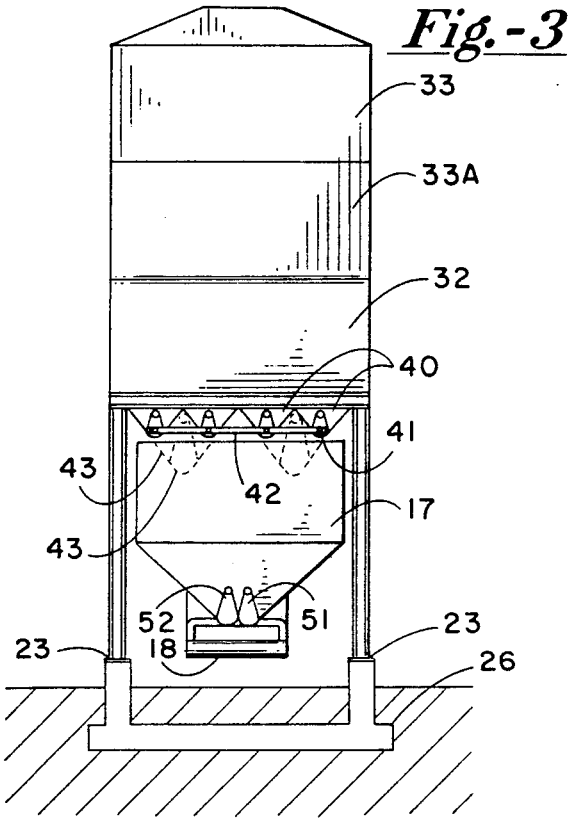
FIG. 3 is an end elevational view from the right end of FIG. 2.

FIG. 1 depicts a side elevation view of a typical transportable concrete batching apparatus or plant in the knockdown configuration ready for addressing an over-the-road tractor to be pulled to a site to be installed. The system is shown generally at 10 and has a reinforced superstructure or structural frame including vertical and horizontal support members which allow the entire system to be carried spanning from a transport tractor connection 11 to a set of wheels 12 in a manner which is designed to contain the system within the maximum allowable load length, height, width and road clearance dimensions. The frame also supports the installed system. The system includes a rather large tank or cement silo 13 which can be provided in several sizes and even shipped separately if a larger silo vessel is desired. Other major elements of the system include a cement batching vessel 14, which communicates with the silo via discharge gate 15 and chute 15A, and with chute 19 via gate 19A, aggregate storage means 16 shown in an inverted position for transport atop the aggregate batching hopper 17 for transport on the highway. Additional height can be added to the sides of the installed aggregate storage means 16 if desired as shown in FIG. 2 and 3. An aggregate conveyor 18 is also provided together with a discharge chute 19 for transferring the batched aggregate materials into a truck or other mixing device.

FIG. 2 depicts the transportable concrete batching apparatus shown in FIG. 1 in its stationary or erected position for operation. The superstructure of the frame for the batching apparatus is provided with pairs of feet one of each of which is shown at 20, 21, 22 and 23 designed to be fixed to poured footings as at 24, 25 and 26 to provide a rigid operating support in a well-known manner. In the erected position the silo 13 is shown in its vertical orientation above the cement batching vessel 14. The vessel 14 itself is suspended from the structure using three strain gauge load cells, which may be S-beam load cells which can also secured in a manner which removes tension from the load cells for transportation as will be described in greater detail with reference to FIGS. 4A and 4B, below.

The aggregate storage bin 16 is divided into several compartments, three of which are shown at 30, 31 and 32 in FIG. 2. Additional height for the aggregate storage bins can be achieved by adding and securing wall sections above the bottom as shown at 33 and 33A in FIGS. 2 and 3. The aggregate batching hopper 17 as shown beneath the aggregate storage bins is also suspended with reference to three load cells one of which is shown at 34. This system operates in the same manner as that associated with the cement weigh batching vessel 14 detailed below. The conveyor 18 connects the truck loading chute 19 with the discharge openings of the aggregate weigh hopper 17 to feed the aggregate portion of the mix associated with each batch.

With respect to more specific details of the invention, FIG. 3 depicts the bottom discharge cones or ports of one of the aggregate storage bins 32. That figure depicts four discharge cones 40 each having a clamshell-type discharge gate 41; all four gates are operated in unison by a common operating rod 42 suitably mechanized in a well-known manner. Prior art devices typically were provided with one or two such discharge cones; the relative position of two such cones is illustrated in phantom at 43. By providing each aggregate bin with four discharge cones, several important advantages are realized. First, it can readily be observed that the required clearance height for the bottom of the bin is substantially reduced and, given a limited overall height, more of the vertical height of the bin can be utilized for loading material into the aggregate weigh hoppers. In any event, it does give the system a definite height advantage over previous models. In addition, the use of four instead of two discharge cones has been found to provide better distribution of the aggregate across the hopper of the batcher 17. This is because piled sand and gravel exhibit an angle of repose and when only two clamshell gates are employed, the material flows out into the batcher in a way that causes larger peaks and valleys which leaves rather large voids at each end due to the angle of repose. The use of four discharge ports substantially reduces the effects of the angle if repose by reducing the peak height.

Figure 6:
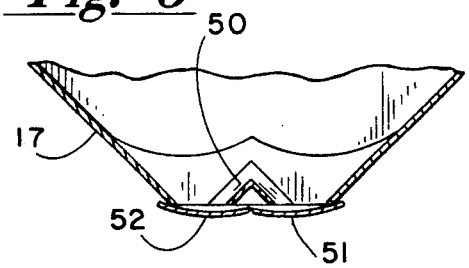
FIG. 6 is a fragmentary elevational section showing the discharge mechanism for the aggregate batcher taken substantially along lines 6—6 of FIG. 5.
Figure 5:
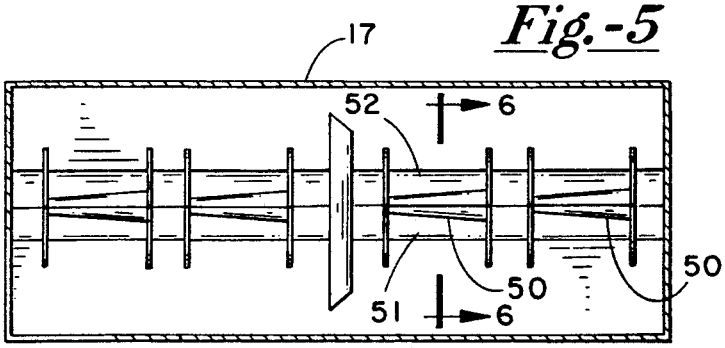
FIG. 5 is a sectional plan view of the inside of the batching hopper taken substantially along lines 5—5 of FIG. 2.

With respect to the aggregate batcher itself, as seen in FIGS. 5 and 6 in addition to FIG. 3, the bottom of the batcher hopper 17 is provided with a plurality of trapezoidal flow diverters 50 to better control the flow of aggregate onto the conveyor 18. Cooperating with the trapezoidal shaped flow diverters 50 is a space-saving double clamshell discharge gate assembly including a pair of cooperating clamshell members 51 and 52 which control the flow of aggregate onto the conveyor together with the trapezoidal-shaped flow diverters 50. The opening of the clamshell gates can be modulated to any desired amount to more closely control the width of the discharge stream deposited on the conveyor 18 with the maximum stream being permitted with the gates entirely open. This permits closer control of the rate of discharge of aggregate onto the conveyor 18 which can also be controlled with reference to conveyor speed. It has been found that the trapezoidal flow diverters at the bottom of the aggregate batcher cooperate with the dual clamshell discharge gates in a manner which stabilizes the rate of flow from the batcher onto the conveyor in manner not possible with prior art configurations.

Figure 4A:
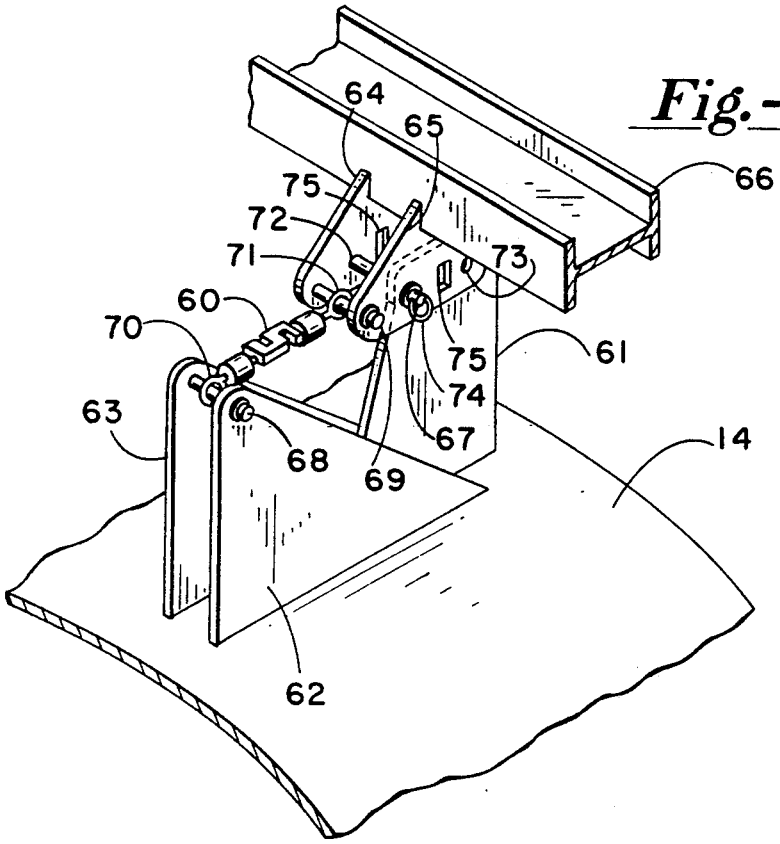
FIGS. 4A and 4B are greatly enlarged fragmentary views depicting the transporting and installed suspension configurations of a load cell in accordance with the invention.
Figure 4B:
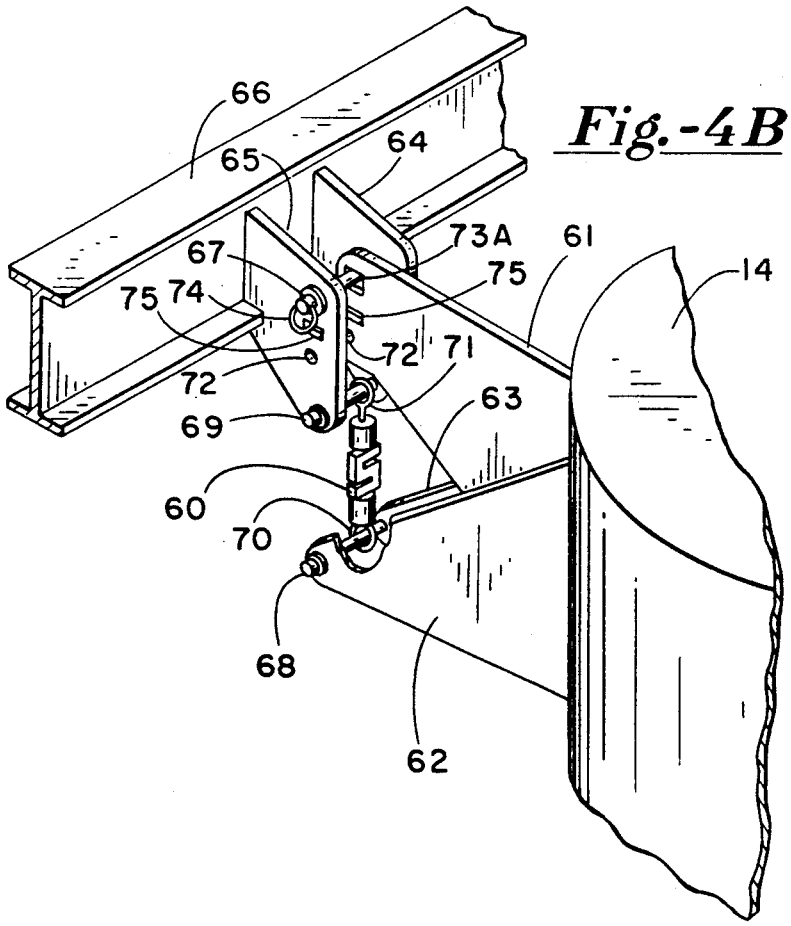

FIGS. 4A and 4B illustrate the manner in which the S-beam load cells are suspended both for transportation and during operation of the system. FIG. 4A depicts a load cell 60 in the transportation or tension-free mode and FIG. 4B, in the fully operational configuration. While the configuration specifically illustrated in FIGS. 4A and 4B depicts how the load cells associated with the cement weight batching vessel, which folds from a vertical operating orientation to a horizontal disposition for transport, are disposed in the two positions it will be appreciated that the load cells of the aggregate batching weigh hopper operate in the same manner with respect to having the two position flange and pin support arrangement illustrated in FIGS. 4A and 4B. Therefore they need not be separately illustrated.

In FIG. 4A a fragment of the wall of cement batching vessel 15 14 is shown as it appears with the support frame folded to a horizontal disposition for shipment and connected to one of three S-beam load cells 60. The load cells are extremely sensitive to tension and monitor the weight of the batching vessel 14 during operation. It is most desirable to have the S-beam load cell free from tension during transportation to prevent damage from over-tension, torsion or other forces which might occur during over-the-road transport or in erection of the system.

The batching vessel 14 is provided with a relatively heavy upper support member or flange 61 and a pair of heavy lower support member flanges as at 62 and 63. A further pair or support members 64 and 65 fixed to a horizontal structural frame beam 66 cooperate with the flange member 61 and members 62 and 63 to support the cement batching vessel 14 in two modes. As shown in FIG. 4A, during the transportation of the system, a pin member 67 supports the vessel 14 by fixing the flange 61 with respect to the support members 64 and 65 via holes 72 (FIG. 4B). Each S-beam 60 is connected between the flange members 64 and 65 and the flanges 62 and 63 by pin members 68 and 69 cooperating with eyelets 70 and 71, respectively; however, when pin 67 is in place in holes 72 the tension is removed from the S-beam, and the weight of the vessel 14 is carried by the pins 67.

In the view of FIG. 4B, the cement batching vessel 14 is depicted in its operational or upright position. In addition to being placed in an upright position, the mode of suspension has been changed so that the weight of the vessel 14 is borne by the S-beam load cells 60. Note that the pin 67 has been removed from the lower holes 72 and placed through upper openings 73 including oversized opening 73A. The oversized opening 73A allows the member 61 sufficient play so that the members 62 and 63 take over as the load bearing support for the vessel 14 with the weight being borne through pin 68 and load cell 60 to pin 69. The pin 67 can be stored in the upper holes 73, secured as by cotter pins as at 74, during operation of the transportable concrete batching system. The transfer of the pin 67 from the holes 72 to the openings 73 and 73A or from the openings 73 and 73A to holes 72 is readily accomplished by inserting a pry bar through slotted openings 75 and prying up on member 61 to release the shear force from the pin 67.

It should further be observed that should the S-beam load cell fail for any reason the member 61 would again assume the load of the vessel 14 via the pin 67 as an additional safety measure once the system is set-up. By utilizing the dual-suspension set up for the S-beam load cells in accordance with the invention, damage to these very expensive, very sensitive critical parts of the entire apparatus during transportation, set up and take-down can be almost entirely eliminated.

In the same manner load cells supporting the aggregate batcher weight hopper can be stress relieved when then system is transported. The basic technique is identical whether the relative position of the supported vessel changes for transport, as is the case with the cement weight batcher 14, or not.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices and that various modifications, both as to equipment details and operating procedures, can be accomplished without departing from the scope of the invention itself.

What is claimed is:

1. An apparatus for supporting a weigh vessel from a structural support frame comprising:

a plurality of structural support members associated with the structural support frame;

a plurality of hanger members each fixed to one of the structural support members;

weighing support system for supporting the vessel in a weighing posture, including:

a first set of vessel support members fixed to the vessel, a plurality of tension-sensitive strain gauges in the form of load cells adapted to suspend the vessel between the plurality of structural support members and the first set of vessel support members fixed to the vessel, alternate support system for supporting the vessel in a posture that relieves the force on the strain gauges of the weighing support system including; a second set of vessel support members fixed to the vessel, and means for supporting the vessel from the second set of support members in lieu of the plurality of strain gauges;

the plurality of hanger members further being disposed to address each of the first and second sets of vessel support members;

pin means fixing each of the load cells between one of the hanger members and a corresponding one of the first set of vessel support members; and wherein the means for supporting each vessel from the second set of vessel support members comprises means for attaching each of the second set of vessel support members to a corresponding one of the hanger members in alternate positions in a manner such that the weight of the weigh vessel is carried by the load cells through the first set of vessel support members when the second set of vessel support members is attached to the hanger members in a first position and the weight of the vessel is borne by the second set of vessel support members when the second set of vessel support members is attached to the hanger members in a second position.

2. The apparatus of claim 1, wherein:

the hanger members are dual spaced flanges provided with alternate first and second sets of holes;

the second set of vessel support members is provided with alternate first and second holes generally in line with the alternate first and second sets of holes in the hanger members;

the apparatus further comprising removable pin means associated with the alternate support system for interchangeable connecting the hanger members to the second set of vessel support members in alternate positions such that in a first position utilizing the first set of holes in the hanger member and the first hole in the vessel support member, the vessel is carried by the load cells and when the pin is in a second position through the second set of holes in the hanger member and the second hole in the vessel support member, the vessel is carried by the second set of vessel support members and the force on the load cells is removed.

3. The apparatus of claim 2 wherein the first set of holes further comprises a corresponding oversized first hole in each of the second set of vessel support members.

4. A transportable concrete batching plant comprising:

a structural support frame;

a plurality of structural support members associated with the structural support frame;

aggregate storage means comprising a plurality of longitudinally disposed bottom discharge aggregate storage bins for containing a plurality of solid materials including sand and stone for use in concrete aggregate batching, wherein each storage bin comprises three or more bottom discharge cones disposed in a transverse row across the width of the bin, each cone having a bottom opening and an associated gate for releasing materials from the bin as required for batching and including means for operating the gates of each bin in unison;

aggregate batching means comprising an aggregate hopper for receiving aggregate materials from each of the aggregate storage bins in any desired proportional amount, the aggregate hopper further comprising gravity-fed bottom discharging system which includes a plurality of trapezoidal flow diverters in combination with a set of dual clamshell gates to modulate the width of discharge flow from the aggregate batching hopper;

first weighing means for weighing the aggregate hopper vessel;

means for relieving the force on the first weighing means;

cement storage silo for storing quantities of cement including means for discharging the cement by gravity therefrom;

cement weigh batching vessel for receiving cement from the silo, means for discharging the cement from the cement weigh batching vessel;

second weighing means for weighing the weigh batching vessel;

means for relieving the force on the second weighing means;

transport conveyor means for receiving aggregate materials discharged from the aggregate batching hopper and transporting the aggregate materials to address a mixing means;

wherein the first and second weighing means further comprise;

a plurality of hanger members each fixed to one of the structural support members, a weighing support system for supporting each vessel in a weighing posture, including, a first set of vessel support members fixed to each vessel, a plurality of tension-sensitive strain gauges in the form of load cells adapted to suspend each vessel between the plurality of structural support members and the first set of vessel support members fixed to each vessel; and wherein the means for relieving the force on the first and second weighing means further comprises;

alternate support system for supporting each vessel in a posture that relieves the force on the strain gauges of the weighing support system including, a second set of vessel support members fixed to each vessel, and means for supporting each vessel from the second set of support members in lieu of the plurality of strain gauges;

the plurality of hanger members further being disposed to address each of the first and second sets of vessel support members, pin means fixing each of the load cells between one of the hanger members and a corresponding one of the first set of vessel support members, and wherein the means for supporting each vessel from the second set of vessel support members comprises means for attaching each of the second set of vessel support members to a corresponding one of the hanger members in alternate positions in a manner such that the weight of the weigh vessel is carried by the load cells through the first set of vessel support members when the second set of vessel support members is attached to the hanger members in a first position and the weight of the vessel is borne by the second set of vessel support members when the second set of vessel support members is attached to the hanger members in a second position.

5. The apparatus of claim 4 wherein:

the hanger members are dual spaced flanges provided with alternate first and second sets of holes;

the second set of vessel support members is provided with alternate first and second holes generally in line with the alternate first and second sets of holes in the hanger members;

the apparatus further comprising removable pin associated with the alternate support system means for interchangeably connecting the hanger members to the second set of vessel support members in alternate positions such that in a first position utilizing the first set of holes in the hanger member and the first hole in the vessel support member, the vessel is carried by the load cells and when the pin is in a second position through the second set of holes in the hanger member and the second hole in the vessel support member, the vessel is carried by the second set of vessel support members and the force on the load cells is removed.

6. The apparatus of claim 5 wherein the first set of holes further comprises an oversized hole in each of the second set of vessel support members.

* * * * *

UNITED STATES PATENT AND TRADEMARK OFFICE

CERTIFICATE OF CORRECTION

PATENT NO. : 5 121 989

DATED : June 16, 1992

INVENTOR(S) : James Horton et al

It is certified that error appears in the above-identified patent and that said Letters Patent is hereby corrected as shown below:

In column 6, line 55,

"alternate support system for supporting the vessel in a posture that relieves the force on the strain gauges of the weighing support system including; a second set of vessel support members fixed to the vessel, and"

should read:

-- alternate support system for supporting the vessel in a posture that relieves the force on the strain gauges of the weighing support system including;

a second set of vessel support members fixed to the vessel, and -- .

In column 7, line 24, delete "interchangeable" and insert -- interchangeably -- .

In column 8, line 1,

"cement storage silo for storing quantities of cement including
means for discharging the cement by gravity therefrom;"

should read:

-- cement storage silo for storing quantities of cement including means for discharging the cement by gravity therefrom; -- .

UNITED STATES PATENT AND TRADEMARK OFFICE

CERTIFICATE OF CORRECTION

PATENT NO. : 5 121 989

DATED : June 16, 1992

INVENTOR(S) : James Horton et al

It is certified that error appears in the above-identified patent and that said Letters Patent is hereby corrected as shown below:

In column 8, beginning at line 5, that subparagraph and the four subparagraphs following it should not be double indented.

Signed and Sealed this

Twelfth Day of October, 1993

*Attest:*

*Attesting Officer*

Bruce Lehman

BRUCE LEHMAN

*Commissioner of Patents and Trademarks*